US007980433B2

(12) United States Patent
Wynn

(10) Patent No.: US 7,980,433 B2
(45) Date of Patent: Jul. 19, 2011

(54) BALL CAP STRETCHING AND BLOCKING SYSTEM, KIT, AND METHOD

(76) Inventor: Vincent D. Wynn, Gallatin, TN (US)

( * ) Notice: Subject to any disclaimer, the term of this patent is extended or adjusted under 35 U.S.C. 154(b) by 982 days.

(21) Appl. No.: 11/837,478

(22) Filed: Aug. 10, 2007

(65) Prior Publication Data

US 2008/0035683 A1 Feb. 14, 2008

Related U.S. Application Data

(60) Provisional application No. 60/822,110, filed on Aug. 11, 2006, provisional application No. 60/925,311, filed on Apr. 18, 2007.

(51) Int. Cl.
*A42C 1/00* (2006.01)

(52) U.S. Cl. ..... 223/25; 223/24

(58) Field of Classification Search ..... 223/24–26
See application file for complete search history.

(56) References Cited

U.S. PATENT DOCUMENTS

| | | | | |
|---|---|---|---|---|
| 388,497 | A | 8/1888 | McLoughlin | |
| 686,674 | A | 11/1901 | Keator | |
| 1,492,083 | A | 4/1924 | Pegues | |
| 1,720,602 | A | 7/1929 | Liverant | |
| 1,914,864 | A | 6/1933 | Purcell | |
| 2,008,638 | A | 7/1935 | Cuming | |
| 2,645,333 | A | 7/1953 | Nelson | 206/8 |
| 3,439,204 | A | 4/1969 | Ponczek et al. | 310/58 |
| 3,498,510 | A | 3/1970 | Johnson | |
| 4,157,151 | A | 6/1979 | Sanko | |
| 4,491,256 | A | 1/1985 | Payne et al. | |
| 4,673,113 | A | 6/1987 | Vandewege | 223/15 |
| 4,708,271 | A | 11/1987 | Grommes | 223/25 |
| 4,739,909 | A | 4/1988 | Bury | |
| 5,094,369 | A | 3/1992 | Thompson | |
| 5,148,954 | A | 9/1992 | Myers | |
| 5,163,589 | A | 11/1992 | Biehl | |
| 5,172,837 | A | 12/1992 | Finney, Jr. et al. | 223/23 |
| 5,725,134 | A | 3/1998 | Weltge | |
| 5,730,006 | A * | 3/1998 | Conley | 68/6 |
| 5,862,522 | A | 1/1999 | Cho | |
| 6,052,928 | A | 4/2000 | Lin | |
| 6,253,973 | B1 * | 7/2001 | Jones | 223/67 |
| 6,581,809 | B1 | 6/2003 | McElhinney | 223/51 |
| 6,883,353 | B2 | 4/2005 | Goldoni et al. | 68/5 A |
| 6,968,985 | B1 | 11/2005 | Caccavallo | |
| 7,022,659 | B2 | 4/2006 | Duquet et al. | 510/439 |
| 2009/0166388 | A1 * | 7/2009 | Bryant | 223/25 |

* cited by examiner

*Primary Examiner* — Shaun R Hurley
*Assistant Examiner* — Andrew W Sutton
(74) *Attorney, Agent, or Firm* — Ashley J. Wells

(57) ABSTRACT

A ball cap blocking and stretching system includes a steamer and a stretcher on which the crown of the ball cap is positioned, and a brim positioner. The steamer has a crown-contourer for contouring the crown that has a hemispherical shape and includes at least one aperture for emitting steam; and a steam generator located substantially within and in communication with the crown-contourer. The stretcher includes a front-contourer overlappingly provided adjacent to the crown-contourer so that the inside surface of the crown of the ball cap covers the front-contourer and the crown-contourer; a mover for cooperatively moving the front-contourer relative to the crown-contourer for stretching at least the perimeter of the crown in cooperation with the steamer; and a stretcher fixator for temporarily fixing the position of the front-contourer relative to the crown-contourer when the mover is moved. Additionally provided is a ball cap blocking and stretching kit and method.

29 Claims, 11 Drawing Sheets

BALL CAP STRETCHING AND BLOCKING SYSTEM, KIT, AND METHOD

CROSS-REFERENCE TO RELATED APPLICATION

The present application is related to and claims priority from prior provisional application Ser. No. 60/822,110, filed Aug. 11, 2006, entitled "BALL CAP STRETCHING AND BLOCKING SYSTEMS", and is related to and claims priority from prior provisional application 60/925,311, filed Apr. 18, 2007, entitled "BALL CAP STRETCHING AND BLOCKING SYSTEMS", the contents of which are incorporated herein by this reference and are not admitted to be prior art with respect to the present invention by the mention in this cross-reference section.

BACKGROUND

The present invention relates to ball cap stretching and blocking systems. Blocking, as defined herein, refers to the process of holding a hat in a shape to impart a definite shape to a hat. More particularly, the present invention relates to a ball cap blocker and stretcher that provides simultaneous ball cap stretching and steaming. The stretching and steaming functions assist in removing undesired creases in the material of ball caps. Even more particularly, the present invention relates to a ball cap blocker and stretcher and steamer that is portable for home use. Also, the present invention relates to a ball cap blocker and stretcher that optionally avoids steaming the decorated front portion of the ball cap, typically displaying, for example, a sports team logo. Even more particularly, the present invention also relates to a ball cap blocker and stretcher and steamer that additionally provides heated air drying of the ball cap.

Modern ball caps have risen to the status of a fashion statement. Thus, it is becoming increasingly important to keep ball caps looking pristine, crisp, and fresh (by cap wearers and retailers). Also, modern ball caps have become collector's items. Further, the licensing of trademarks for placement on ball caps is ever present. The most widely recognized name in the licensed ball cap arena is New Era, the largest sports-licensed headwear company in the U.S. and the official ball cap licensee of MLB. A New Era cap, typically a fitted cap, has a very distinctive look comprising a flat bill, a squared front crown, and a holographic sticker validating the authenticity of the cap placed on the cap's visor. Ball caps bearing a licensed logo generally range in price from $29 up to $300 for collector versions, with $2,000 premium caps, such as the Zerino "Elita" and "Dominiani", emerging in the market for the first time. Modern ball caps range from a simple ball cap with a functional use to investments.

Typical materials in a ball cap respond to heating, steaming, and stretching. Ball caps, especially those comprising wool and buckram, can warp when wet. However heating and steaming can restore the shape of a ball cap. The fibers in wool typically respond quickly to steaming. Buckram, a rigid, malleable material which is typically contained within the front two panels of a ball cap may be shaped by heating or steaming. The buckram weave enables an embroidered logo on the cap's crown to hold its shape. A cap's sweatband typically comprises cotton and because of its position close to the head, it dirties quickly necessitating frequent washing.

No system exists that provides simultaneous ball cap stretching and steaming. Further, no system exists that provides a ball cap blocker and stretcher and steamer that is portable for home use. Also, no system exists that optionally avoids steaming the decorated front portion of the ball cap. Even more particularly, no system exists that provides a ball cap blocker and stretcher and steamer that provides heated air drying of the ball cap.

Therefore, a need exists for a system that provides simultaneous ball cap stretching and steaming. Further, a need exists for a system that provides a ball cap blocker and stretcher and steamer that is portable for home use. Also, a need exists for a system that optionally avoids steaming the decorated front portion of the ball cap. Even more particularly, a need exists for a system that provides a ball cap blocker and stretcher and steamer that provides heated air drying of the ball cap.

OBJECTS AND FEATURES OF THE INVENTION

A primary object and feature of the present invention is to provide a ball cap stretching and blocking systems.

A further object and feature of the present invention is to provide simultaneous ball cap stretching and steaming. It is a further object and feature of the present invention to provide such a system that is portable for home use. It is yet another object and feature of the present invention to provide such a system that protects the decorated front portion of a baseball cap from steam. It is a further object and feature of the present invention to provide such a system that provides heated air-drying of the ball cap.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a ball cap blocking and stretching system, relating to blocking at least one ball cap, such at least one ball cap having at least one crown and at least one brim, such at least one crown having at least one front, at least one inside surface, and at least one outside surface, such ball cap blocking and stretching system comprising: at least one steamer structured and arranged to steam such at least one crown, such at least one steamer comprising at least one crown-contourer structured and arranged to contour such at least one crown adjacent such at least one inside surface of such at least one crown, at least one steam generator structured and arranged to generate steam, wherein such at least one steam generator is located substantially within such at least one crown-contourer, wherein such at least one crown contourer comprises at least one aperture structured and arranged to emit steam from such at least one steam generator through such at least one aperture; at least one stretcher structured and arranged to stretch such at least one crown, such at least one stretcher comprising at least one front-contourer structured and arranged to contour such at least one front of such at least one crown adjacent to such at least one inside surface of such at least one crown and adjacent to such at least one brim, at least one mover structured and arranged to move such at least one front-contourer relative to such at least one crown-contourer, and at least one stretcher fixator structured and arranged to temporarily fix the relative position of such at least one front-contourer and such at least one crown-contourer when such at least one mover is moved; and at least one brim positioner structured and arranged to position such at least one brim relative to at least one front of such at least one crown, wherein such at least one brim positioner is attached to such at least one front-contourer. Moreover, it provides such a ball cap blocking and stretching system wherein such at least one steamer comprises at least one water storage tank structured and arranged to store at least one amount of water. Additionally, it provides such a ball cap blocking and stretching system wherein such at least one steam generator comprises at least one heat generator structured and arranged to generate heat; and wherein such at least one heat generator comprises at least one electrical heating element. Also, it provides such a ball cap blocking and stretching system further comprising at least one steam controller structured and arranged to control steam generation by such at least one steam generator. In addition, it provides such a ball cap blocking and stretching system wherein such at least one steam controller comprises at least one water pump structured and arranged to pump water from such at least one water storage tank to such at least one heat generator; and at least one water valve structured and arranged to release water from such at least one water storage tank to such at least one heat generator. And, it provides such a ball cap blocking and stretching system wherein such at least one steam aperture comprises a plurality of steam apertures through such at least one crown-contourer, distributed about such at least one crown-contourer, and placed adjacent such at least one inside surface of such at least one ball cap. Further, it provides such a ball cap blocking and stretching system wherein such at least one front-contourer comprises a plurality of steam apertures through such at least one front-contourer. Even further, it provides such a ball cap blocking and stretching system further comprising at least one size indicator structured and arranged to indicate to a user at least one user-selectable stretchable size of at least one ball cap when at least one ball cap is placed on such ball cap blocking and stretching system, wherein such user-selectable stretchable sizes are based on the relative positions of such at least one crown-contourer and such at least one front-contourer. Moreover, it provides such a ball cap blocking and stretching system further comprising at least one support base structured and arranged to support at least such at least one steamer, such at least one stretcher, and such at least one brim positioner above at least one surface. Additionally, it provides such a ball cap blocking and stretching system further comprising at least one handle structured and arranged to assist portably handling such ball cap blocking and stretching system. Also, it provides such a ball cap blocking and stretching system according to claim 1 further comprising at least one hot air blower structured and arranged to blow hot air to at least one ball cap when at least one ball cap is placed on such at least one crown contourer. In addition, it provides such a ball cap blocking and stretching system wherein such at least one hot air blower comprises at least one heating element structured and arranged to generate heat; at least one fan to blow such generated heat as hot air; at least one port structured and arranged to pass hot air from such at least hot air blower to at least one ball cap when such at least one ball cap is placed on such at least one crown contourer. And, it provides such a ball cap blocking and stretching system wherein such at least one hot air blower is located substantially within such at least one crown contourer. Further, it provides such a ball cap blocking and stretching system wherein such at least one mover comprises at least one screw-drive. Even further, it provides such a ball cap blocking and stretching system wherein such at least one mover comprises at least one ratchet-drive.

In accordance with another preferred embodiment hereof, this invention provides a ball cap blocking and stretching kit, relating to blocking at least one ball cap, such at least one ball cap having at least one crown and at least one brim, such at least one crown having at least one front, at least one inside surface, and at least one outside surface, such ball cap blocking and stretching kit comprising: at least one blocker structured and arranged to block at least one ball cap wherein such at least one blocker comprises at least one steamer structured and arranged to steam such at least one crown, such at least one steamer comprising at least one crown-contourer structured and arranged to contour such at least one crown adjacent such at least one inside surface of such at least one crown, and at least one steam generator structured and arranged to generate steam, wherein such at least one steam generator is located substantially within such at least one crown-contourer, wherein such at least one crown contourer comprises at least one aperture structured and arranged to emit steam from such at least one steam generator through such at least one aperture; at least one stretcher structured and arranged to stretch such at least one crown, such at least one stretcher comprising at least one front-contourer structured and arranged to contour such at least one front of such at least one crown adjacent to such at least one inside surface of such at least one crown and adjacent to such at least one brim, at least one mover structured and arranged to move such at least one front-contourer relative to such at least one crown-contourer, and at least one stretcher fixator structured and arranged to temporarily fix the relative position of such at least one front-contourer and such at least one crown-contourer when such at least one mover is moved; and at least one brim positioner structured and arranged to position such at least one brim relative to at least one front of such at least one crown, wherein such at least one brim positioner is attached to such at least one front-contourer; at least one packaging structured and arranged to package such at least one blocker; and at least one instruction structured and arranged to instruct at least one user in the use of such at least one blocker. Moreover, it provides such a ball cap blocking and stretching kit further comprising at least one second front-contourer interchangeable with such at least one front-contourer. Additionally, it provides such a ball cap blocking and stretching kit wherein such at least one front-contourer comprises at least one front steam aperture through such at least one front-contourer. Also, it provides such a ball cap blocking and stretching kit further comprising at least one cleaning solution. In addition, it provides such a ball cap blocking and stretching kit further comprising at least one stain remover solution. And, it provides such a ball cap blocking and stretching kit further comprising at least one stiffening solution. Further, it provides such a ball cap blocking and stretching kit further comprising at least one ball cap washing basket.

In accordance with another preferred embodiment hereof, this invention provides a ball cap blocking and stretching method, relating to blocking at least one ball cap, such at least one ball cap having at least one crown and at least one brim, such at least one crown having at least one front, at least one inside surface, and at least one outside surface, such ball cap blocking and stretching system comprising the steps of: acquiring at least one ball cap blocker streamer stretcher, wherein such at least one ball cap blocker steamer stretcher weighs less than about ten pounds; adding water to at least one water reservoir of such at least one ball cap blocker steamer stretcher; selecting at least one ball cap; placing such at least one ball cap on such at least one ball cap blocker steamer stretcher; steaming such at least one ball cap; stretching such at least one ball cap; removing such at least one ball cap from such at least one ball cap blocker steamer stretcher; and storing such at least one ball cap blocker steamer stretcher. Even further, it provides such a ball cap blocking and stretching method further comprising the step of drying such at least one ball cap prior to the step of removing such at least one ball cap from such at least one ball cap blocker steamer stretcher. Even further, it provides such a ball cap blocking and stretching method further comprising the step of washing such at least one ball cap prior to such step of placing such at least one ball cap on such at least one ball cap blocker steamer stretcher. Even further, it provides such a ball cap blocking and stretching method further comprising the step of applying at least one ball cap treatment solution to such at least one ball cap. Even further, it provides such a ball cap blocking and stretching method further comprising the step of restricting such step of steaming such at least one ball cap to steaming such at least one crown of such at least one ball cap. Even further, it provides such a ball cap blocking and stretching method further comprising the step of restricting such step of steaming such at least one ball cap to steaming areas of such at least one ball cap that do not comprise embroidery. Even further, it provides such a ball cap blocking and stretching method further comprising the step of restricting such step of steaming such at least one ball cap to steaming areas of such at least one ball cap that do not comprise decorative printing.

In accordance with another preferred embodiment hereof, this invention provides a ball cap blocking system, relating to blocking at least one ball cap having at least one inside surface, at least one outside surface, at least one crown, and at least one brim, comprising; steamer means for steaming such at least one crown, comprising crown-contour means for contouring such at least one crown adjacent such at least one inside surface, steam generator means for generating steam, wherein such steam generator means is located substantially within such crown-contour means, steam aperture means for providing steam apertures through such crown-contour means, and at least one steam controller means for controlling steam generation; stretcher means for stretching such at least one crown, comprising front-contour means for contouring at least one front of such at least one crown adjacent such at least one inside surface and adjacent such at least one brim, at least one mover means for moving such front-contour means relative to such crown-contour means, and stretcher fixation means for temporarily fixing the relative position of such front-contour means and such crown-contour means; at least one brim positioner means for positioning such at least one brim relative to such at least one front of such at least one crown, wherein such at least one brim positioner means is attached to such front contour means; at least one size indicator means for indicating the size of such at least one ball cap based on the relative positions of such crown-contour means and such front-contour means; and at least one housing means for housing such steamer means, such stretcher means, such at least one brim positioner means, and such at least one size indicator means.

Moreover, it provides such a ball cap blocking system, further comprising at least one handle means for handling such at least one housing means. Additionally, it provides such a ball cap blocking system, wherein such steamer means comprises heat generator means for generating heat. Also, it provides such a ball cap blocking system, wherein such heat generator means comprises at least one electric heating element. In addition, it provides such a ball cap blocking system, wherein such steamer means comprises water storage means for storing water prior to heating such water into steam. And, it provides such a ball cap blocking system, wherein such at least one steam controller means comprises water pump means for pumping water from such water storage means to such heat generator means. Further, it provides such a ball cap blocking system, wherein such at least one steam controller means comprises water valve means for releasing water from such water storage means to such heat generator means.

Even further, it provides such a ball cap blocking system, wherein such at least one mover means comprises stretcher fixation releaser means for releasing such stretcher fixation means whereby such front-contour means is again able to move relative to such crown-contour means. Even further, it provides such a ball cap blocking system, wherein such at least one mover means comprises grip means for gripping such front-contour means and such at least one housing means simultaneously. Even further, it provides such a ball cap blocking system, wherein such at least one housing means comprises steam aperture means for providing steam apertures through such at least one housing means. Even further, it provides such a ball cap blocking system, wherein such at least one housing means, such stretcher means, such at least one brim positioner means, and such at least one size indicator means together weigh less than about ten pounds. Even further, it provides such a ball cap blocking system, wherein at least one of such at least one housing means, such stretcher means, such at least one brim positioner means, and such at least one size indicator means comprises plastic.

Even further, it provides such a ball cap blocking system, wherein such steam aperture means comprises a plurality of steam apertures through such crown-contour means, distributed about such crown-contour means, and adjacent such inside surface of such ball cap. Even further, it provides such a ball cap blocking system, wherein such stretcher means is adjustable between a circumference of not less than fifteen inches and a circumference of not more than thirty inches. Even further, it provides such a ball cap blocking system, wherein such stretcher means is adjustable between a circumference of not less than nineteen inches and a circumference of not more than twenty-seven inches. Even further, it provides such a ball cap blocking system, wherein such stretcher means is adjustable between a circumference of not less than nineteen inches and a circumference of not more than twenty-three inches. Even further, it provides such a ball cap blocking system, wherein such stretcher means is adjustable between a circumference of not less than twenty-two inches and a circumference of not more than twenty-six inches. Even further, it provides such a ball cap blocking system, wherein such stretcher means is adjustable between a circumference of not less than twenty-one inches and a circumference of not more than twenty-four inches.

Even further, it provides such a ball cap blocking system, wherein such front-contour means comprises front steam aperture means for providing steam apertures through such front-contour means. Even further, it provides such a ball cap blocking system, wherein such front-contour means is structured and arranged to conform to the contour of the front of at least one low-profile ball cap. Even further, it provides such a ball cap blocking system, wherein such front-contour means is structured and arranged to conform to the contour of the front of at least one high-profile ball cap. Even further, it provides such a ball cap blocking system, wherein such at least one mover means comprises at least one screw-drive. Even further, it provides such a ball cap blocking system, wherein such at least one mover means comprises at least one ratchet-drive.

DETAILED DESCRIPTION OF THE BEST MODES AND PREFERRED EMBODIMENTS OF THE INVENTION

Figure 1:
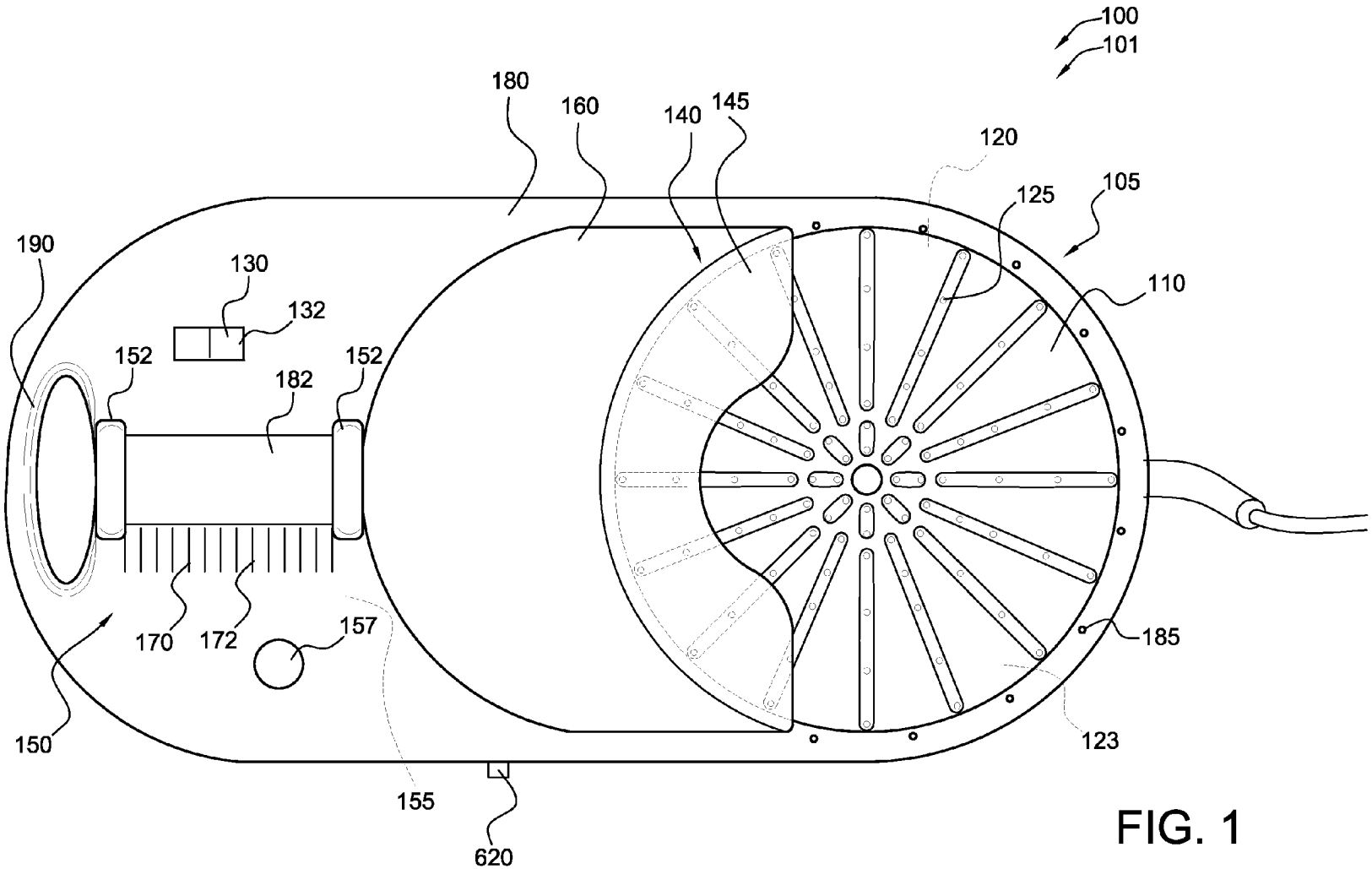
FIG. 1 shows a top view illustrating a ball cap blocker and stretcher according to a preferred embodiment of the present invention.

FIG. 1 shows a top view illustrating ball cap blocker and stretcher 101 according to a preferred embodiment of the present invention.

Figure 5A:
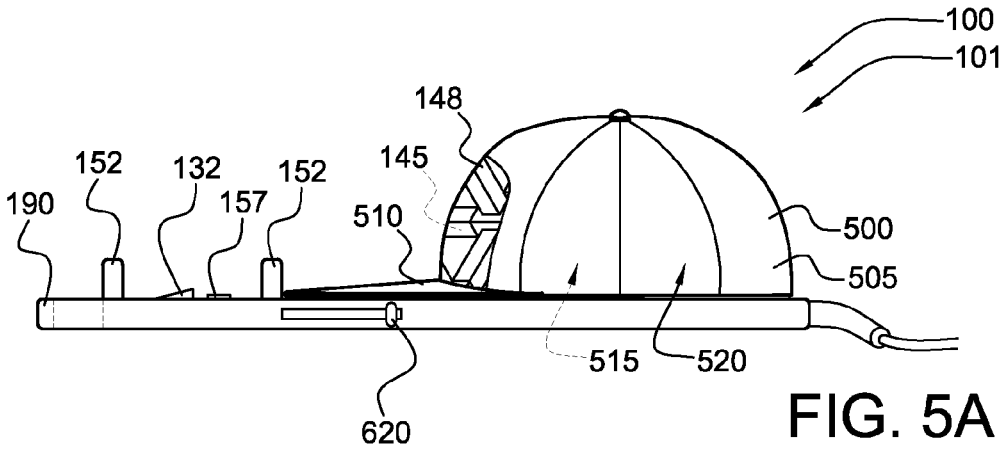
FIG. 5A shows a side view illustrating the ball cap blocker and stretcher according to the preferred embodiment of FIG. 1, with a ball cap in place.

Preferably, ball cap blocker and stretcher system 100 is adapted to stretch and/or steam ball caps 500, as shown in FIG. 5A. Preferably, ball cap 500 comprises crown 505, brim 510, inside surface 515, and outside surface 520, as shown in FIG. 5A. Preferably, brim 510 encircles less than half of crown 505, as shown. Ball caps 500 are typically sold as "baseball caps", "ball caps", "trucker caps", "athletic caps", "mesh caps", "casual caps", "runner's caps", "fitted caps", etc.

Preferably, ball cap blocker and stretcher system 100 comprises ball cap blocker and stretcher 101, as shown. Preferably, ball cap blocker and stretcher 101 comprises steamer 105, stretcher 140, brim positioner 160, size indicator 170, and housing 180, as shown. Preferably, the housing of the systems described herein acts as a support base for at least the steamer, stretcher, and brim positioner, as shown. Preferably, housing 180 may be placed on a user-desired surface, such as a counter or desk. Upon reading the teachings of this specification, those with ordinary skill in the art will now understand that, under appropriate circumstances, considering such issues as advances in technology, user preference, etc., other ball cap blocker and stretcher components, such as a dryer, a clamp to shape the brim, etc., may suffice.

Figure 5B:
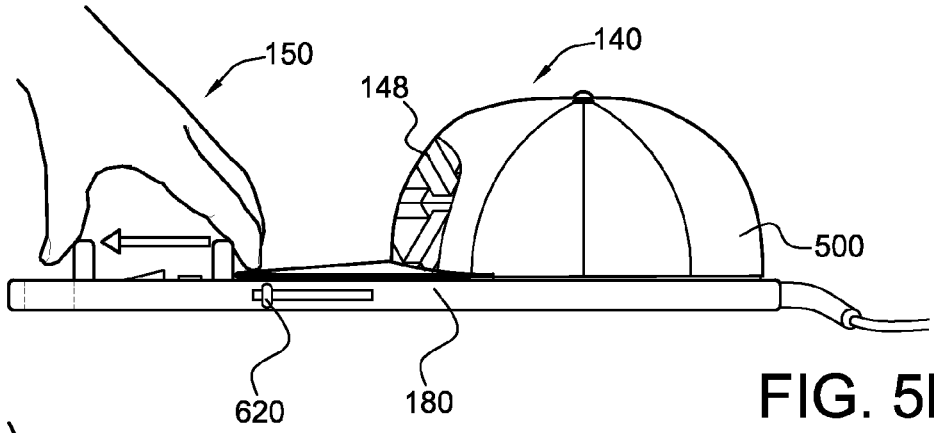
FIG. 5B shows a side view illustrating the ball cap blocker and stretcher according to the preferred embodiment of FIG. 1, stretching the ball cap.
Figure 5C:
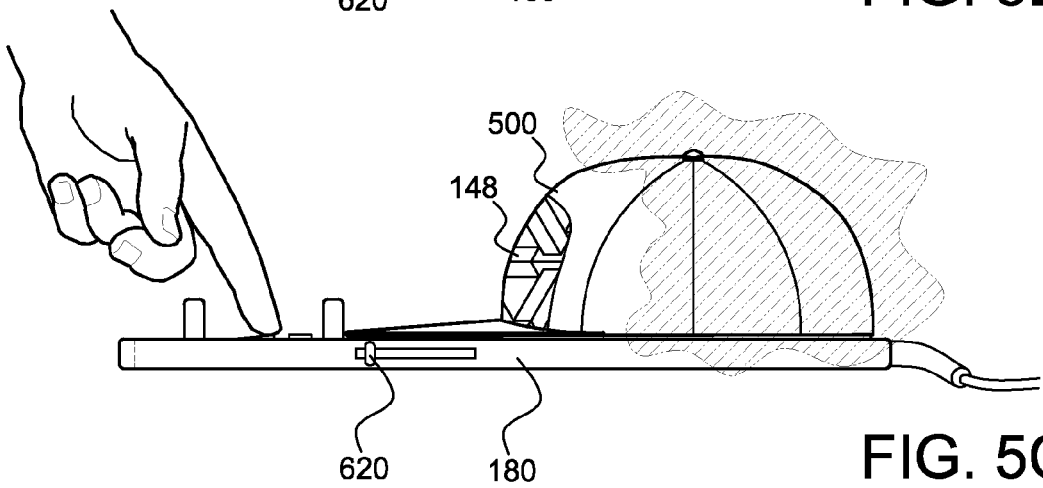
FIG. 5C shows a side view illustrating the ball cap blocker and stretcher according to the preferred embodiment of FIG. 1, steaming the ball cap.
Figure 6:
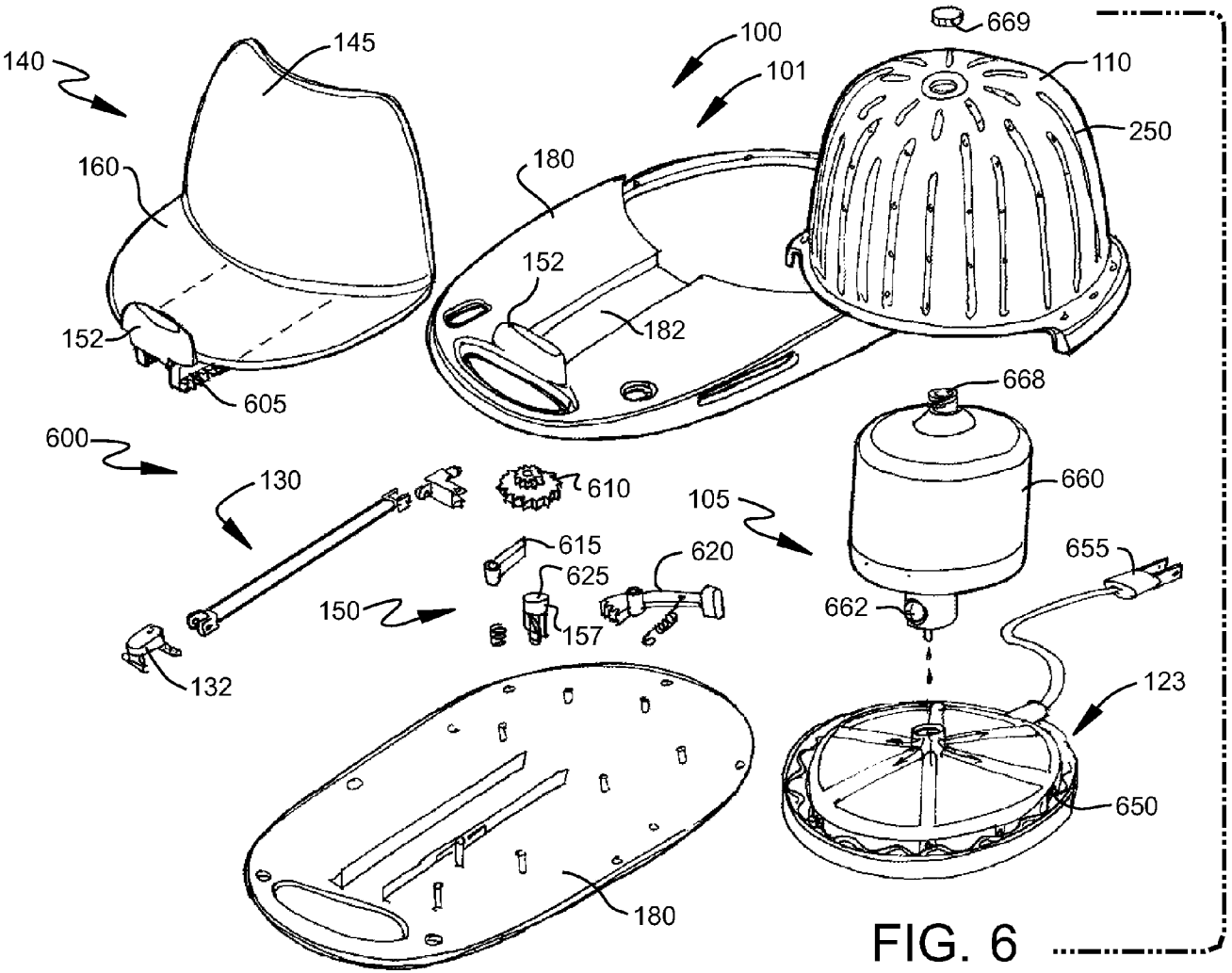
FIG. 6 shows an exploded perspective view illustrating the ball cap blocker and stretcher according to the preferred embodiment of FIG. 1.

Preferably, steamer 105 comprises crown-contourer 110, steam generator 120, steam aperture 125, and steam controller 130, as shown. Preferably, crown-contourer 110 is adapted to approximately match the contour of crown 505 adjacent inside surface 515, as shown. Preferably, crown-contourer 110 is approximately shaped like the inside of ball cap 500, as shown. More preferably, crown-contourer 110 is approximately hemispherical, as shown. Preferably, steam generator 120 generates steam, as shown in FIG. 5C. Preferably, steam generator 120 is located substantially within crown-contourer 110, as shown in FIG. 6. Preferably, steam flows from steam generator 120 through steam apertures 125 to the exterior of crown-contourer 110. Preferably, a plurality of steam apertures 125 are distributed about crown-contourer 110, as shown, placed to release steam adjacent such inside surface 515 of ball cap 500. Preferably, a plurality of steam apertures 125 (at least embodying herein at least one steam aperture through such at least one crown-contourer) are approximately evenly distributed in a pattern about crown-contourer 110 (at least embodying herein wherein such at least one steam aperture comprises a plurality of steam apertures through such at least one crown-contourer, distributed about such at least one crown-contourer, and placed to be adjacent such inside surface of such ball cap), as shown. Upon reading the teachings of this specification, those with ordinary skill in the art will now understand that, under appropriate circumstances, considering such issues as advances in technology, user preference, etc., other steam-aperture arrangements, such as the crown-contourer being uniformly porous, the crown-contour comprising strong mesh material, other patterns of steam apertures, steam being generated outside of the crown-contour, etc., may suffice.

Preferably, steam controller 130 permits the user to control the generation of steam by steam generator 120, as shown in FIG. 5C. Preferably, steam controller 130 (at least embodying herein at least one steam controller structured and arranged to control steam generation by such at least one steam generator) comprises steam button 132, as shown. Preferably, steam generator 120 (at least embodying herein at least one steam generator structured and arranged to generate steam, wherein such at least one steam generator is located substantially within such at least one crown-contourer) comprises at least one heat generator 123, located within housing 180 and/or within crown-contourer 110, as shown in FIG. 6. Preferably, heat generator 123 (at least embodying herein wherein such at least one steam generator comprises at least one heat generator structured and arranged to generate heat) is adapted to generate heat for making steam. Preferably, heat generator 123 (at least embodying herein wherein such at least one heat generator comprises at least one electrical heating element) comprises at least one electrical heating element, as shown in FIG. 6. Upon reading the teachings of this specification, those with ordinary skill in the art will now understand that, under appropriate circumstances, considering such issues as advances in technology, user preference, etc., other steam controllers, such as automatic timers, manual timers, automatic shutoff based on water level, etc., may suffice.

Preferably, stretcher 140 (at least embodying herein at least one stretcher fixator structured and arranged to temporarily fix the relative position of such at least one front-contourer and such at least one crown-contourer) comprises front-contourer 145, mover 150, and stretcher fixator 155, as shown. Preferably, front-contourer 145 is adapted to approximately match the contour of ball cap 500 adjacent the front portion of inside surface 515 and preferably adjacent brim 510, as shown in FIG. 5A. Preferably, mover 150 is adapted to move front-contourer 145 relative to crown-contourer 110, as shown in FIG. 5B. Preferably, mover 150 (at least embodying herein at least one mover structured and arranged to move such at least one front-contourer relative to such at least one crown-contourer) is adapted to move front-contourer 145 horizontally relative to crown-contourer 110, as shown. Preferably, front-contourer 145 is adapted to conform to the contour of the front of a low-profile ball cap 500 (such as, for example, a baseball league ball cap), as shown in FIG. 5A. Preferably, stretching occurs between front-contourer 145 and crown-contourer 110, as shown. Preferably, front-contourer 145 is approximately shaped like the front of crown 505 and the brim 510 of ball cap 500, as shown, while crown-contourer 110 is approximately shaped like the back of crown 505 of ball cap 500, as shown. Therefore, stretcher 140 is preferably radially asymmetrical, as shown. Upon reading the teachings of this specification, those with ordinary skill in the art will now understand that, under appropriate circumstances, considering such issues as advances in technology, user preference, etc., other stretcher components, such as a motor, a non-slip surface and/or clips to hold the ball cap in place, vertical movement of the crown-contourer relative to the housing, vertical movement of the front-contourer relative to the housing, etc., may suffice.

Preferably, front-contourer 145 does not comprise steam apertures 125, as shown. Preferably, front-contourer 145 shields the front of crown 505 and brim 510 from steam, as shown in FIG. 5C. The front of crown 505 is preferably decorated with decorations 148, as shown in FIG. 5A. Preferably, decorations 148 comprise at least one of embroidery, printing, appliqués, etc. Depending on their materials and construction, many decorations 148 may be damaged by steam. Further, decorations 148 may stretch at different rates than the surrounding wet fabric, resulting in damage, puckers, or distortion of decorations 148 and/or crown 505. Preferably, preventing steam from wetting the front of crown 505 and decorations 148 limits the amount of stretching that occurs adjacent decorations 148. Preferably, steam hitting the back of front-contourer 145 escapes through crown 505. Preferably, the heat and tension on crown 505 adjacent front-contourer 145 results in wrinkles being ironed out. Upon reading the teachings of this specification, those with ordinary skill in the art will now understand that, under appropriate circumstances, considering such issues as advances in technology, user preference, etc., other arrangements, such as a front-contour adapted to limit heat transfer, a front-contour with its own heater, etc., may suffice.

Preferably, mover 150 comprises stretcher fixator 155, as shown. Preferably, stretcher fixator 155 is adapted to temporarily lock front-contourer 145 in place relative to crown-contourer 110, as shown. Preferably, stretcher fixator 155 (at least embodying herein wherein such at least one mover comprises at least one stretcher fixator releaser structured and arranged to release such stretcher fixator whereby such at least one front-contourer is again able to move relative to such at least one crown-contourer) comprises a ratchet system, as further shown and described in FIG. 6. Preferably, stretcher fixator 155 comprises a screw, as further shown and described in FIG. 7. Preferably, mover 150 comprises stretcher fixator releaser 157, as shown. Preferably, stretcher fixator releaser 157 is adapted to release said stretcher fixator 155 whereby front-contourer 145 is again able to move relative to crown-contourer 110.

Preferably, brim positioner 160 is adapted to position brim 510 relative to the front of crown 505, as shown in FIG. 5A. Preferably, brim positioner 160 is fixedly attached to front-contourer 145 (at least embodying herein at least one front-contourer structured and arranged to contour at least one front of such at least one crown adjacent such at least one inside surface and adjacent such at least one brim), as shown. Preferably, brim positioner 160 is adapted to support brim 510 approximately horizontally relative to crown 505, as shown. Preferably, brim positioner 160 occupies less than one-half of the circumference of crown-contourer 110 (at least embodying herein comprising at least one crown-contourer structured and arranged to contour such at least one crown adjacent such at least one inside surface), as shown, to match the design of most ball caps 500. Upon reading the teachings of this specification, those with ordinary skill in the art will now understand that, under appropriate circumstances, considering such issues as advances in technology, user preference, etc., other brim positioners, such as adjustable brim positioners, brim positioners fixed to the housing, brim positioners molded into the housing, brim positioners with adjustable vertical curvature, brim positioners with an adjustable horizontal tilt, etc., may suffice.

Preferably, size indicator 170 is adapted to indicate the size of ball cap 500 based on the relative positions of crown-contourer 110 and front-contourer 145, as shown. Preferably, size indicator comprises ball cap size indicators in at least the following ball cap dimensions: 6, 6⅛, 6¼, 6⅜, 6½, 6⅝, 6¾, and 6⅞, 7, 7⅛, 7¼, 7⅜, 7½, 7⅝, 7¾, 7⅞, 8, 8⅛, 8¼, 8⅜, etc. Preferably, moving front-contourer 145 relative to crown-contourer 110 changes the length of the circumference around front-contourer 145 and crown-contourer 110, measured adjacent brim positioner 160, which circumference is preferably correlated to standard hat sizes. Preferably, markings 172 indicate the size of ball cap 500, as shown. Preferably, stretcher 140 is adjustable between a circumference of not less than fifteen inches and a circumference of not more than thirty inches. More preferably, stretcher 140 is adjustable between a circumference of not less than nineteen inches and a circumference of not more than twenty-seven inches. Preferably, stretcher 140 is adjustable between a circumference of not less than nineteen inches and a circumference of not more than twenty-three inches. Preferably, stretcher 140 is adjustable between a circumference of not less than twenty-two inches and a circumference of not more than twenty-six inches. Most preferably, stretcher 140 is adjustable between a circumference of not less than twenty-one inches and a circumference of not more than twenty-four inches. Upon reading the teachings of this specification, those with ordinary skill in the art will now understand that, under appropriate circumstances, considering such issues as advances in technology, user preference, etc., other circumferences, other measurement methods, etc., may suffice.

Preferably, housing 180 is adapted to house steamer 105 (at least embodying herein at least one steamer structured and arranged to steam such at least one crown), stretcher 140 (at least embodying herein at least one stretcher structured and arranged to stretch such at least one crown), brim positioner 160 (at least embodying herein at least one brim positioner structured and arranged to position such at least one brim relative to such at least one front of such at least one crown, wherein such at least one brim positioner is attached to such at least one front-contourer), and size indicator 170 (at least embodying herein at least one size indicator structured and arranged to indicate the size of such at least one ball cap based on the relative positions of such at least one crown-contourer and such at least one front-contourer), as shown. Preferably, mover 150 comprises at least one grip 152 (at least embodying herein wherein such at least one mover comprises at least one grip structured and arranged to assist gripping such at least one front-contourer and such at least one housing simultaneously) adapted to assist gripping front-contourer 145 and housing 180 simultaneously so that front-contourer 145 can be easily pulled forward along track 182 in housing 180 in order to stretch ball cap 500, as shown in FIG. 5B.

Preferably, ball cap blocker and stretcher 101 comprises handle 190, as shown. Preferably, handle 190 (at least embodying herein at least one handle structured and arranged to handle such at least one housing) is molded into housing 180, as shown. Upon reading the teachings of this specification, those with ordinary skill in the art will now understand that, under appropriate circumstances, considering such issues as advances in technology, user preference, etc., other handles, such as external handles, removable handles, multiple handles, no handle, handles positioned near a crown-contourer, etc., may suffice.

Preferably, housing 180 comprises at least one steam aperture 185 through housing 180, as shown. Preferably, steam flows from steam generator 120 through steam apertures 185 to the exterior of housing 180 (at least embodying herein at least one housing structured and arranged to house such at least one steamer, such at least one stretcher, such at least one brim positioner, and such at least one size indicator). Preferably, steam apertures 185 (at least embodying herein wherein such at least one housing comprises at least one steam aperture through such at least one housing) are located in housing 180 adjacent crown-contourer 110, as shown. Preferably, steam apertures 185 focus additional steam onto the lower edge of crown 505, which typically comprises multiple layers of fabric or other reinforcement. Upon reading the teachings of this specification, those with ordinary skill in the art will now understand that, under appropriate circumstances, considering such issues as advances in technology, user preference, etc., other steam aperture positions, such as under brim positioner 160, etc., may suffice.

Preferably, ball cap blocker and stretcher 101 weighs less than about ten pounds (with an empty water reservoir). Preferably, ball cap blocker and stretcher 101 (at least embodying herein wherein such at least one housing, such at least one stretcher, such at least one brim positioner, and such at least one size indicator together weigh less than about ten pounds) is portable due to the low weight. Preferably, in order to reduce weight, at least one of housing 180, stretcher 140, brim positioner 160, and size indicator 170 comprises plastic (at least embodying herein wherein at least one of such at least one housing, such at least one stretcher, such at least one brim positioner, and such at least one size indicator comprises plastic). Upon reading the teachings of this specification, those with ordinary skill in the art will now understand that, under appropriate circumstances, considering such issues as advances in technology, user preference, etc., other weights portable by a single user, such as under fifteen pounds, under five pounds, etc., may suffice.

Figure 2:
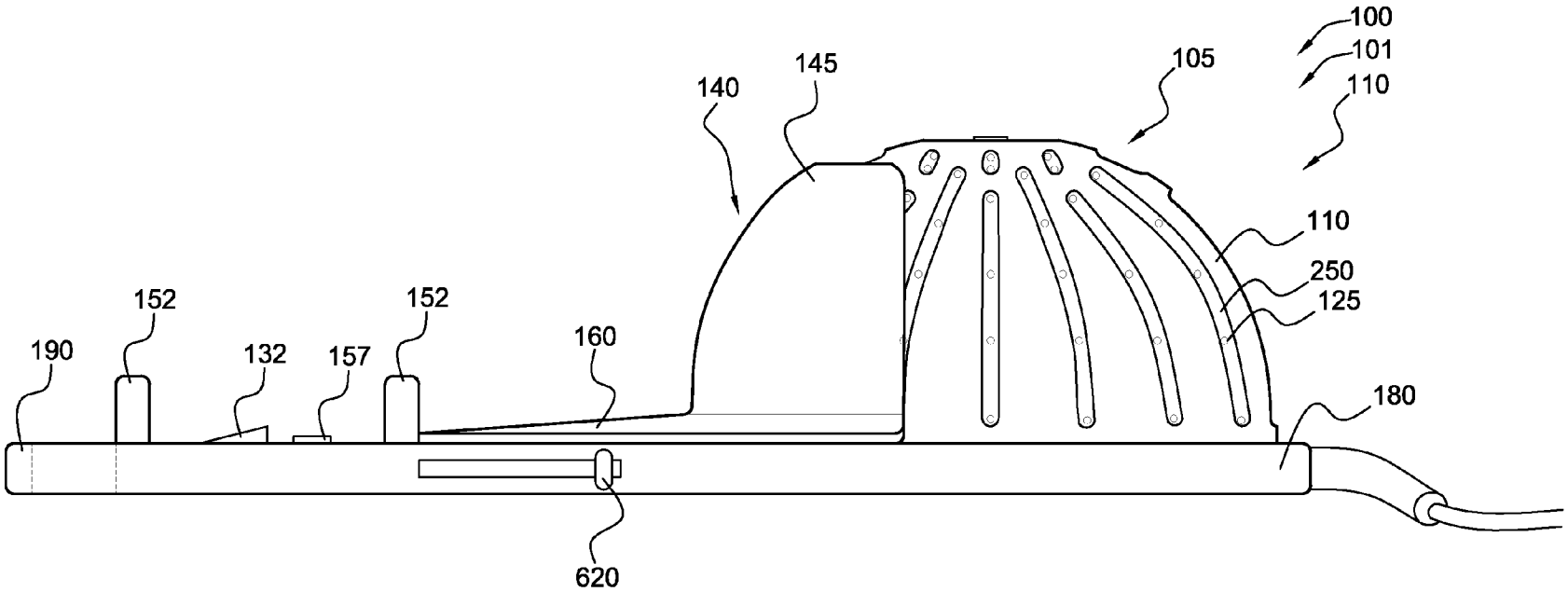
FIG. 2 shows a side view illustrating the ball cap blocker and stretcher according to the preferred embodiment of FIG. 1.

FIG. 2 shows a side view illustrating ball cap blocker and stretcher 101 according to the preferred embodiment of FIG. 1. Preferably, pulling ratchet-arm 620 forward (towards handle 190, as shown) pulls front-contourer 145 forward with sufficient force to stretch ball cap 500. Ratchet-arm 620 is further shown and described in FIG. 6.

Preferably, crown-contourer 110 comprises steam distribution channels 250. Preferably, steam distribution channels 250 help to distribute steam evenly to crown 505. Upon reading the teachings of this specification, those with ordinary skill in the art will now understand that, under appropriate circumstances, considering such issues as advances in technology, user preference, etc., other steam distribution methods, such as crown-contourer comprising mesh, crown-contourer comprising evenly perforated material, etc., may suffice.

Figure 3:
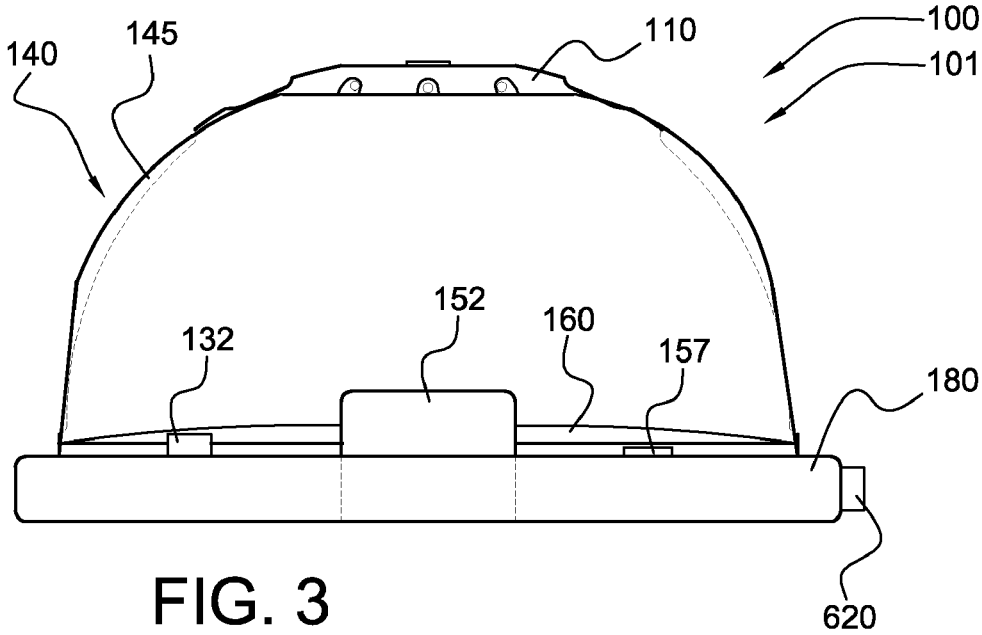
FIG. 3 shows a front view illustrating the ball cap blocker and stretcher according to the preferred embodiment of FIG. 1.

FIG. 3 shows a front view illustrating ball cap blocker and stretcher 101 according to the preferred embodiment of FIG. 1.

Figure 4:
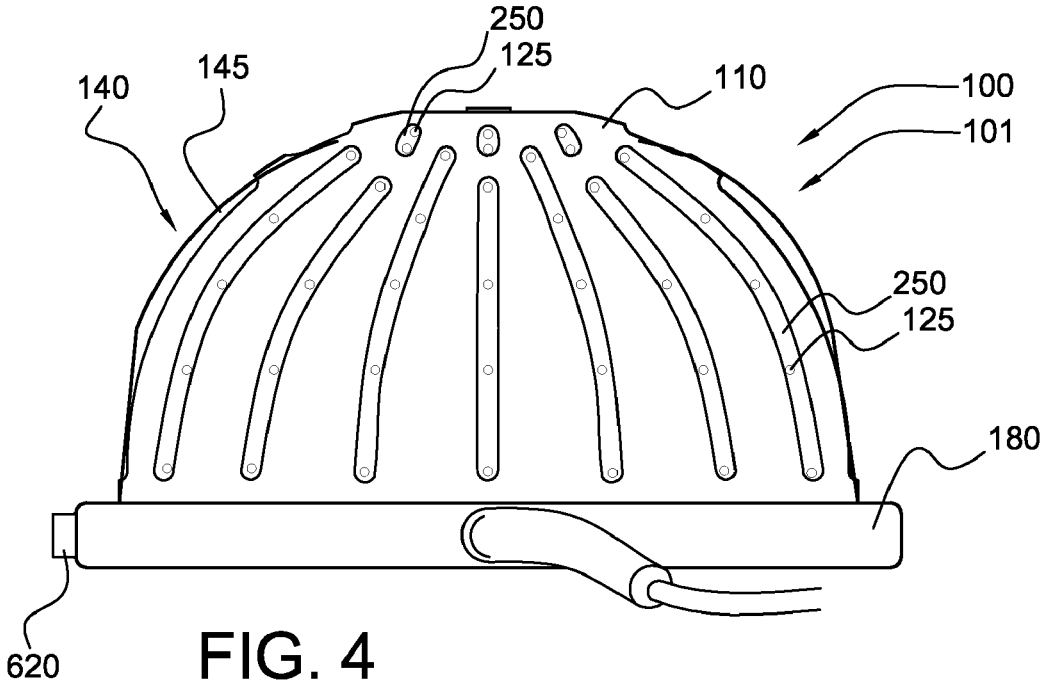
FIG. 4 shows a back view illustrating the ball cap blocker and stretcher according to the preferred embodiment of FIG. 1.

FIG. 4 shows a back view illustrating ball cap blocker and stretcher 101 according to the preferred embodiment of FIG. 1.

FIG. 5A shows a side view illustrating ball cap blocker and stretcher 101 according to the preferred embodiment of FIG. 1, with ball cap 500 in place.

FIG. 5B shows a side view illustrating ball cap blocker and stretcher 101 according to the preferred embodiment of FIG. 1, stretching ball cap 500. Preferably, the user uses grip 152 to pull front-contourer 145 towards handle 190 enough to measure ball cap 500 using size indicator 170 as a guide, as shown. Preferably, the user uses grip 152 to pull front-contourer 145 forward enough to stretch ball cap 500, as shown. Preferably, if more than slight stretching is required, the user pulls ratchet-arm 620 forward to pull front-contourer 145 forward with sufficient force to stretch ball cap 500.

Figure 9:
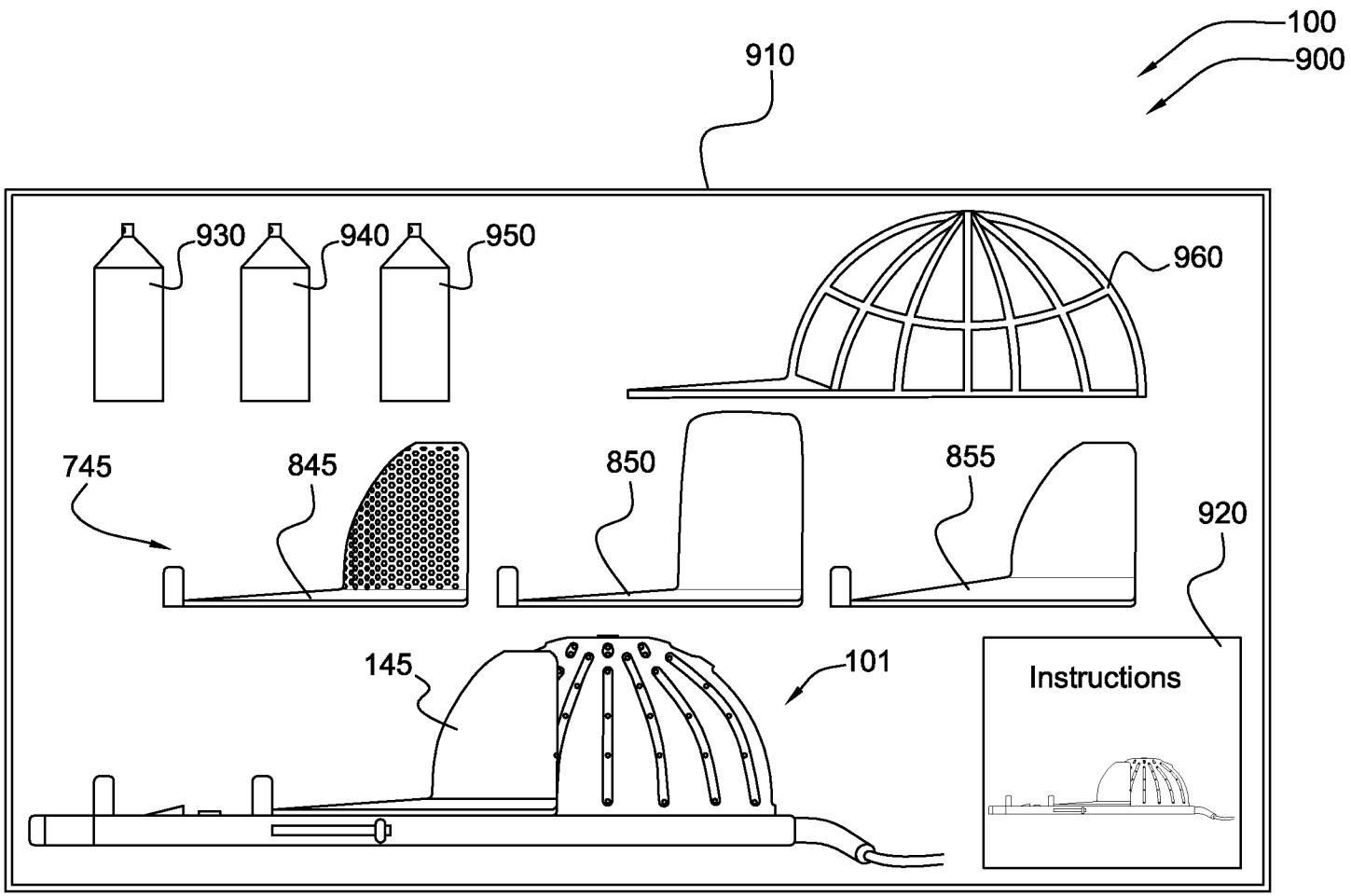
FIG. 9 shows a side view illustrating a kit according to the preferred embodiment of the present invention.

FIG. 5C shows a side view illustrating ball cap blocker and stretcher 101 according to the preferred embodiment of FIG. 1, steaming ball cap 500. Preferably, ball cap 500 is steamed until wrinkles are substantially steamed out. Preferably, ball cap 500 is steamed until stiffener solution 950 (as shown in FIG. 9) has set. Preferably, ball cap 500 is steamed for less than one minute. Upon reading the teachings of this specification, those with ordinary skill in the art will now understand that, under appropriate circumstances, considering such issues as advances in technology, user preference, etc., other arrangements, such as the crown contourer being heated without steam, the crown contourer comprising a forced-air dryer, etc., may suffice.

FIG. 6 shows an exploded perspective view illustrating ball cap blocker and stretcher 101 according to the preferred embodiment of FIG. 1.

Preferably, mover 150 comprises at least one ratchet-drive 600, as shown. Preferably, ratchet-drive 600 (at least embodying herein wherein such at least one mover comprises at least one ratchet-drive) comprises gear rack 605 on front-contourer 145, ratchet gear 610, ratchet hold-back 615, ratchet arm 620, and ratchet release 625, as shown. Preferably, ratchet gear 610 pushes gear rack 605 forward in track 182 in order to stretch ball cap 500. Preferably, ratchet hold-back 615 holds ratchet gear 610 to prevent ratchet gear 610 from turning clockwise (which would permit front contourer 145 to move backwards toward crown-contourer 110). Preferably, ratchet release 625 releases ratchet hold-back 615 from ratchet gear 610, permitting front contourer 145 to move backwards toward crown-contourer 110. Upon reading the teachings of this specification, those with ordinary skill in the art will now understand that, under appropriate circumstances, considering such issues as advances in technology, user preference, etc., other ratchet systems may suffice.

Preferably, heat generator 123 comprises electrical heating element 650, as shown. Preferably, electrical heating element 650 is electrically connected to electrical plug 655, as shown. Preferably, electrical plug 655 plugs in to a standard household electrical outlet. Upon reading the teachings of this specification, those with ordinary skill in the art will now understand that, under appropriate circumstances, considering such issues as advances in technology, user preference, etc., other power sources, such as batteries, solar cells, etc., may suffice.

Preferably, steamer 105 comprises water storage tank 660, as shown, adapted to store water prior to heating such water into steam. Preferably, water tank 660 is located within crown-contour 110 above heat generator 123, as shown. Preferably, steam controller 130 comprises pump bladder 662, as shown. Preferably, pump bladder 662 comprises at least one pump and/or valve adapted to release and/or pump water from water tank 660 when activated, as shown. Preferably, water is gravity-fed from water storage tank 660 (at least embodying herein wherein such at least one steamer comprises at least one water storage tank structured and arranged to store water prior to heating such water into steam) into heat generator 123 when pump bladder 662 (at least embodying herein wherein such at least one steam controller comprises at least one water pump structured and arranged to pump water from such at least one water storage tank to such at least one heat generator; and at least embodying herein wherein such at least one steam controller comprises at least one water valve structured and arranged to release water from such at least one water storage tank to such at least one heat generator) is depressed by activating steam controller 130 (preferably by pressing steam button 132), as shown. Upon reading the teachings of this specification, those with ordinary skill in the art will now understand that, under appropriate circumstances, considering such issues as advances in technology, user preference, etc., other water storage arrangements, such as storing the water in the housing, powered water pumps, etc., may suffice.

Preferably, water is added to water storage tank 660 through filling port 668. Preferably, filling port 668 extends through crown-contourer 110, as shown. Preferably, filling port 668 is closed with cap 669, as shown.

The above arrangement at least embodying herein at least one ball cap blocker streamer stretcher.

Figure 7:
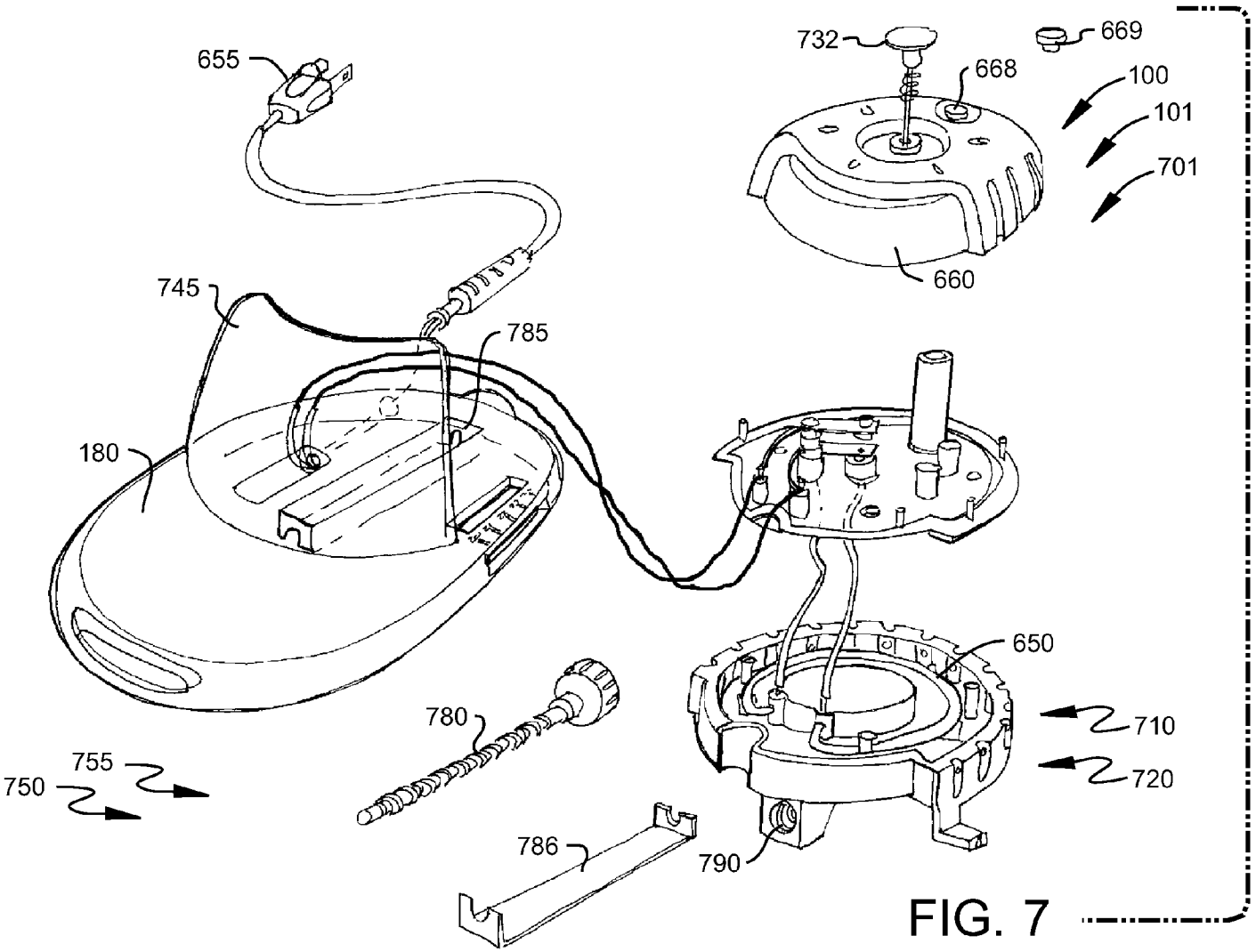
FIG. 7 shows an exploded perspective view illustrating a ball cap blocker and stretcher according to another preferred embodiment of the present invention.

FIG. 7 shows an exploded perspective view illustrating ball cap blocker and stretcher 701 according to another preferred embodiment of the present invention. Preferably, ball cap blocker and stretcher 101 comprises ball cap blocker and stretcher 701, as shown. Preferably, mover 150 comprises mover 750, as shown. Preferably, crown-contourer 110 comprises crown-contourer 710, as shown. Preferably, front-contourer 145 comprises front-contourer 745, as shown. Preferably, steamer 120 comprises steamer 720, as shown.

Preferably, mover 750 is adapted to move crown-contourer 710 relative to front-contourer 745, as shown. Preferably, mover 750 is adapted to move crown-contourer 710 horizontally relative to front-contourer 745, as shown. Preferably, mover 750 comprises at least one screw-drive 755 (at least embodying herein wherein such at least one mover comprises at least one screw-drive), as shown.

Preferably, screw-drive 755 comprises screw 780, track 785, track clip 786, and threaded axle 790, as shown. Preferably, threaded axle 790 runs along track 785 as screw 780 is turned. Preferably, screw 780 is tight enough that screw 780 remains fixed in place after tightening until the user turns it again.

Preferably, steam controller 130 comprises steam button 732, as shown. Preferably, pressing steam button 732 triggers steam release from crown-contourer 710. Under appropriate circumstances pressing steam button 732 functions to momentarily supply power to the steam generator in order to enhance safety and operational economy to reduce electrical load associated with continuous operation of the heating element of the steam generator.

Figure 8C:
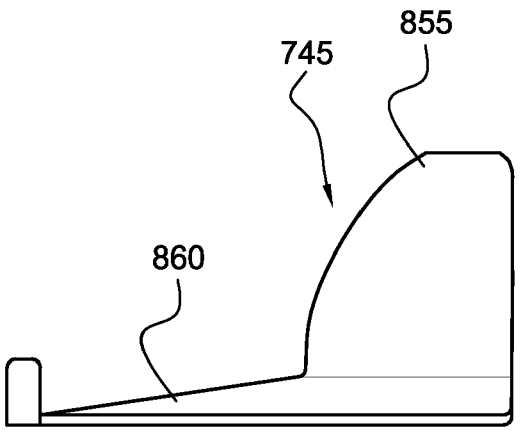
FIG. 8C shows a side view illustrating yet another modified front-contour according to the preferred embodiment of FIG. 1.
Figure 8B:
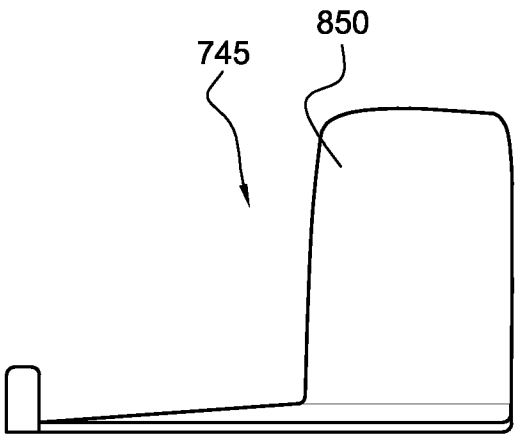
FIG. 8B shows a side view illustrating another modified front-contour according to the preferred embodiment of FIG. 1.
Figure 8A:
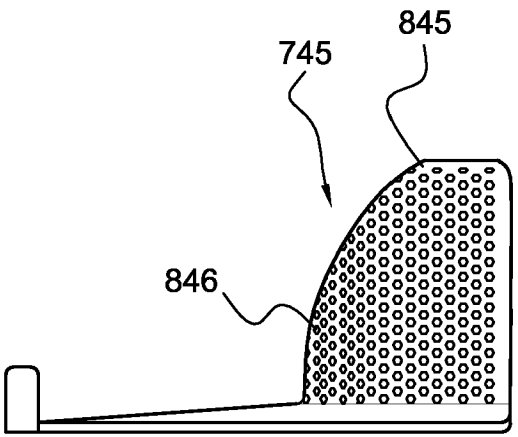
FIG. 8A shows a side view illustrating a modified front-contour according to the preferred embodiment of FIG. 1.

FIG. 8A shows a side view illustrating modified front-contour 845 according to the preferred embodiment of FIG. 1. Preferably, front-contourer 745 comprises front-contourer 845, as shown. Preferably, front-contourer 845 comprises a plurality of steam apertures 846 through front-contourer 845, as shown. Preferably, front-contourer 845 permits steam to reach the front of ball cap 500. Preferably, front-contourer 845 (at least embodying herein wherein such at least one front-contourer comprises a plurality of steam apertures through such at least one front-contourer) is used with ball caps 500 that are either undecorated or that have decorations 148 that are not harmed by steam.

FIG. 8B shows a side view illustrating another modified front-contour 850 according to the preferred embodiment of FIG. 1. Preferably, front-contourer 745 comprises front-contourer 850, as shown. Preferably, front-contourer 850 is structured and arranged to conform to the contour of the front of a high-profile ball cap 500, such as, for example, a "trucker cap", as shown.

FIG. 8C shows a side view illustrating yet another modified front-contour 855 according to the preferred embodiment of FIG. 1. Preferably, front-contourer 745 comprises front-contourer 855, as shown. Preferably, brim positioner 160 comprises brim positioner 860, as shown. Preferably, front-contourer 855 comprises brim positioner 860, as shown. Preferably, brim-positioner 860 is shaped to impart a selected curved shape into brim 510.

Preferably, front-contourer 745, front-contourer 845, front-contourer 850, front-contourer 855 are interchangeable by the user in ball cap blocker and stretcher 101. Upon reading the teachings of this specification, those with ordinary skill in the art will now understand that, under appropriate circumstances, considering such issues as advances in technology, user preference, etc., other front contourers, such as heated front-contourers, no front-contourers, etc., may suffice.

FIG. 9 shows a side view illustrating kit 900 according to the preferred embodiment of the present invention. Preferably, ball cap blocker and stretcher system 100 comprises kit 900, as shown. Preferably, kit 900 permits users to purchase a kit comprising one or a plurality of front-contourer 145 to use to block ball cap 500.

Preferably, kit 900 comprises ball cap blocker and stretcher 101 including at least one first front-contourer 145, packaging 910 (at least embodying herein at least one packaging structured and arranged to packaging such at least one blocker) adapted package said ball cap blocker and stretcher 101 for sale; and instructions 920 (at least embodying herein at least one instruction structured and arranged to instruct at least one user in the use of such at least one blocker) to instruct a user in the use of ball cap blocker and stretcher 101, as shown.

Preferably, kit 900 (at least embodying herein a ball cap blocking kit) comprises at least one second front-contourer 145 interchangeable with said at least one first front-contourer 145 (at least embodying herein at least one second front-contourer interchangeable with such at least one front-contourer), as shown. Preferably, said at least one second front-contourer 145 comprises front-contourer 845, as shown.

Preferably, kit 900 comprises cleaning solution 930, as shown. Preferably, cleaning solution 930 comprises a cleaning solution adapted to remove sweat and dirt from fabric, such as, for example, laundry detergent. Preferably, kit 900 comprises stain remover solution 940, as shown. Preferably, stain remover solution 940 comprises a stain remover adapted to remove stains from fabric, such as, for example, dry-cleaning solvent. Preferably, kit 900 comprises stiffening solution 950, as shown. Preferably, stiffening solution 950 comprises a stiffening solution adapted to stiffen the fabric of ball cap 500. Preferably, stiffening solution 950 interacts with the steam generated by ball cap steamer 101 to stiffen ball cap 500. Preferably, stiffening solution 950 comprises liquid starch solution. Such solutions (cleaning, stain remover, stiffening) also referred to herein as a ball cap treatment solution.

Preferably, kit 900 comprises ball cap washing basket 960, as shown. Preferably, ball cap washing basket 960 permits ball cap 500 to be laundered in a washing machine or dishwasher without being crushed. Preferably, ball cap 500 is laundered prior to steaming and/or stretching with ball cap steamer 101. Upon reading the teachings of this specification, those with ordinary skill in the art will now understand that, under appropriate circumstances, considering such issues as advances in technology, user preference, etc., other kit components, such as a funnel, a cover, a surge protector, a ball cap, an adapter to change the shape of the crown-contour, etc., may suffice.

Figure 10:
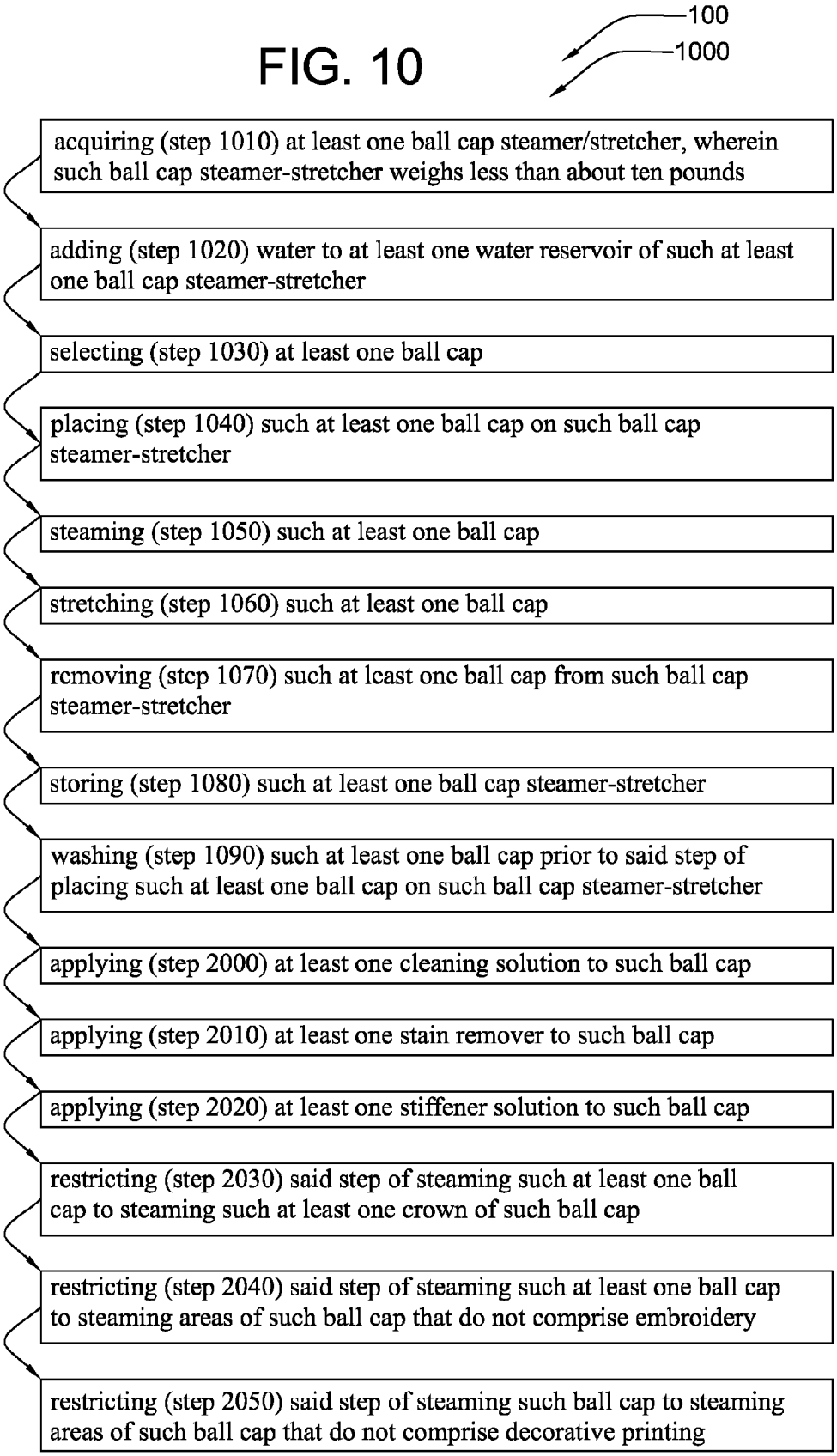
FIG. 10 shows a block diagram illustrating a method according to the preferred embodiment of the present invention.

FIG. 10 shows a block diagram illustrating method 1000 according to the preferred embodiment of the present invention. Preferably, ball cap blocker and stretcher system 100 comprises method 1000, as shown. Preferably, method 1000 comprises the steps of: acquiring (step 1010) ball cap steamer 101, wherein ball cap steamer 101 weighs less than about ten pounds; adding water (step 1020) to water tank 660 of ball cap steamer 101; selecting (step 1030) at least one ball cap 500; placing (step 1040) such ball cap 500 on such ball cap steamer 101; steaming (step 1050) such ball cap 500; stretching (step 1060) such ball cap 500; removing (step 1070) such ball cap 500 from such ball cap steamer 101; and storing (step 1080) such ball cap steamer 101, as shown.

Preferably, method 1000 comprises the step of washing (step 1090) such ball cap 500 prior to placing (step 1040) such ball cap 500 on such ball cap steamer 101, as shown.

Preferably, method 1000 comprises the step of applying (step 2000) at least one cleaning solution 930 to such ball cap 500, either prior to steaming or during steaming, as shown. Preferably, method 1000 comprises the step of applying (step 2010) at least one stain remover from stain remover solution 940 to such ball cap 500, as shown. Preferably, method 1000 comprises the step of applying (step 2020) at least one stiffener solution 950 to such ball cap 500, as shown.

Preferably, method 1000 comprises the step of restricting (step 2030) said step of steaming (step 1050) such ball cap 500 to steaming crown 505 of ball cap 500, as shown. Preferably, method 1000 comprises the step of restricting (step 2040) said step of steaming (step 1050) such ball cap 500 to steaming areas of such ball cap 500 that do not comprise embroidery, as shown. Preferably, method 1000 comprises the step of restricting (step 2050) said step of steaming (step 1050) such ball cap 500 to steaming areas of such ball cap 500 that do not comprise decorative printing, as shown.

Figure 11:
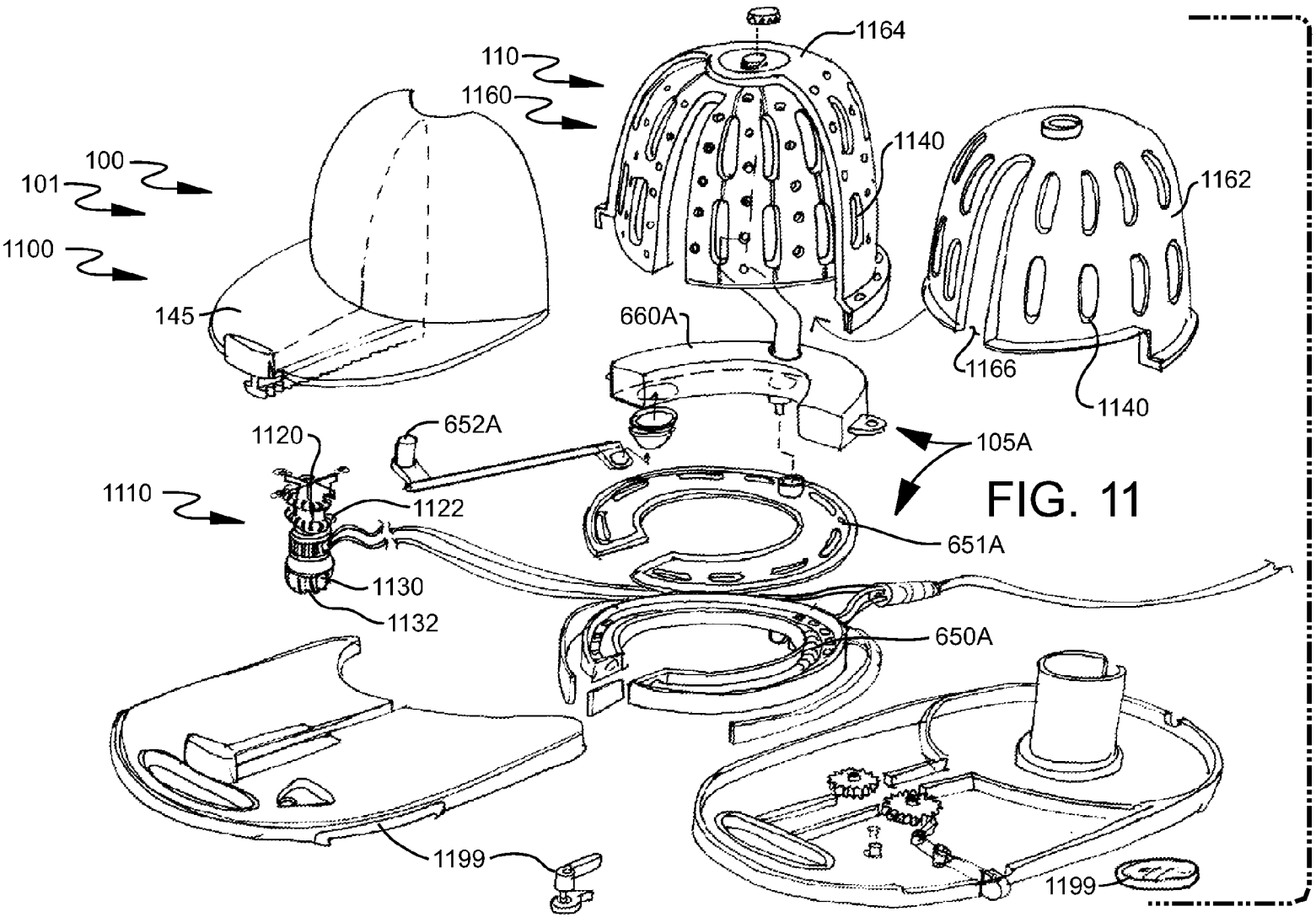
FIG. 11 shows an exploded perspective view illustrating a ball cap blocker and stretcher according to yet another preferred embodiment of the present invention.

FIG. 11 shows an exploded perspective view illustrating ball cap blocker and stretcher 1100 according to yet another preferred embodiment of the present invention. Preferably, ball cap blocker and stretcher system 100 comprises ball cap blocker and stretcher 1100, as shown. Preferably, ball cap blocker and stretcher 101 comprises ball cap blocker and stretcher 1100, as shown. Preferably, ball cap blocker and stretcher 1100 comprises hot air blower 1110, as shown. Preferably, hot air blower 1110 comprises air heater 1120 (preferably comprising a heating element), air blower 1130 also referred to herein as a fan, and air ports 1140, as shown. Preferably, air heater 1120 heats air with heater coil 1122. Preferably, air blower 1130 blows the hot air with fan 1132. Preferably, air ports 1140 allow air to flow from air blower 1130 through crown-contourer 110 to ball cap 500. Preferably, hot air blower 1110 is placed and substantially located within crown-contourer 110, as shown. Upon reading the teachings of this specification, those of ordinary skill in the art will now understand that, under appropriate circumstances, considering such issues as air flow, engineering design considerations, etc., other arrangements for hot air blower, such as, for example, at least one hot air hose coupled to a hot air blower within a crown contourer, multiple hot air hoses coupled to a hot air blower within a crown contourer, etc., may suffice.

Preferably, crown-contourer 110 comprises crown-contourer 1160, as shown. Preferably, crown-contourer 1160 comprises inside shell 1162 and outside shell 1164, as shown. Preferably, inside shell 1162 and outside shell 1164 fit together leaving airspace 1166 in between. Preferably, steam is directed into airspace 1166 so that the area underneath and inside crown-contourer 1160 remains dry. Preferably, air ports 1140 go through inside shell 1162 and outside shell 1164, as shown. Preferably, air blower 1130 is activated by the user as needed.

Preferably, ball cap blocker and stretcher 1100 comprises steam generator 105A, as shown. Preferably, steam generator 105A comprises water tank 660A, electrical heating element 650A (preferably from at least one heat resistant material, more preferably a metallic composition, most preferably aluminum), and heating element cover 651A, as shown. Preferably, steam is activated by steam actuator 652A, preferably a user-accessible control preferably interacting with water tank 660A to deposit water onto heating element cover 651A. Preferably, ball cap blocker and stretcher 1100 comprises secondary system structures 1199, such as a ratchet release arm, screen cap for hot air blower, support chassis, support housings, etc., as shown.

The above arrangement at least embodying herein at least one ball cap blocker streamer stretcher dryer.

Figure 12:
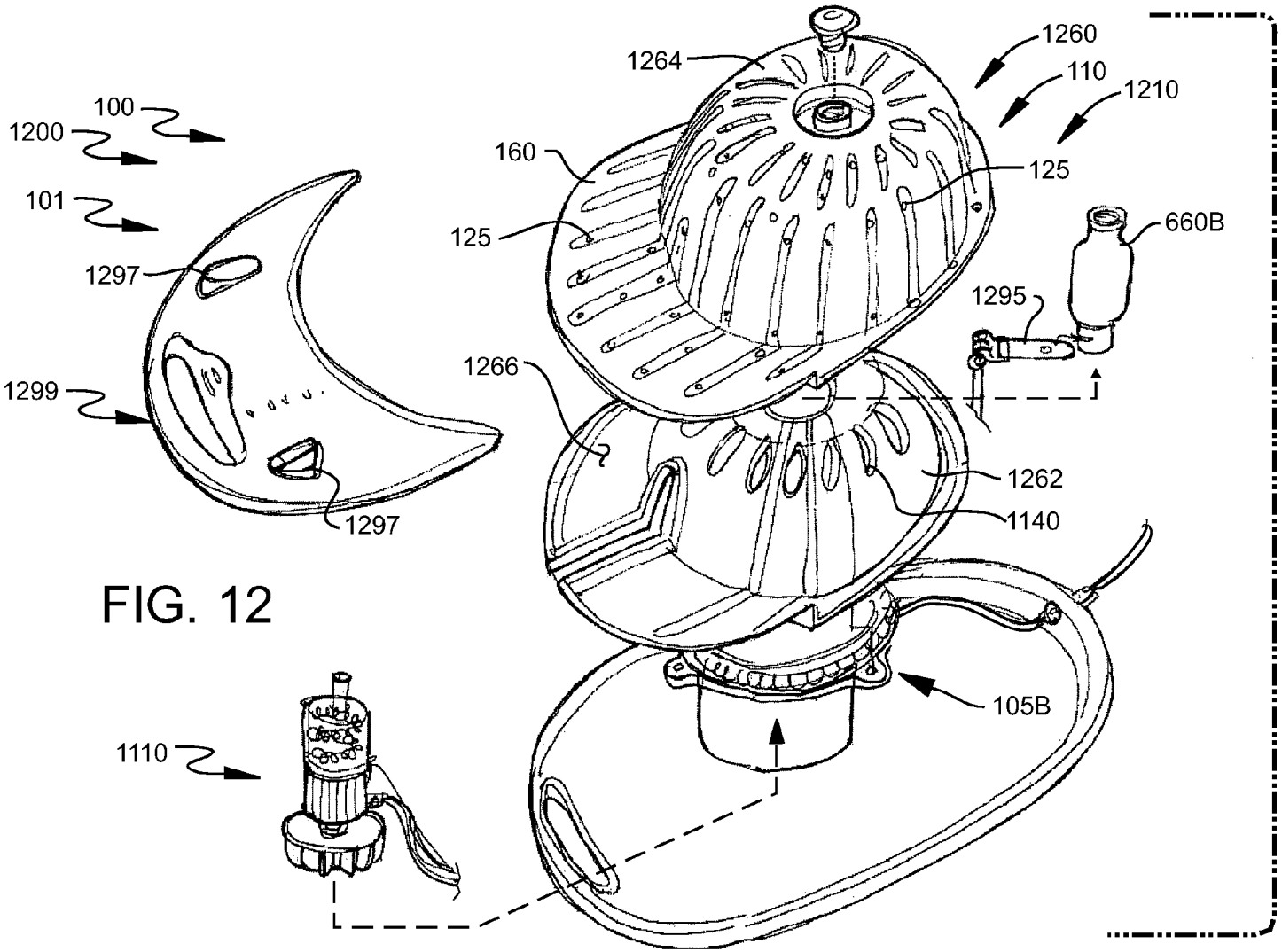
FIG. 12 shows an exploded perspective view illustrating a ball cap blocker and stretcher according to an additional preferred embodiment of the present invention.

FIG. 12 shows an exploded perspective view illustrating ball cap blocker and stretcher 1200 according to an additional preferred embodiment of the present invention. Preferably, ball cap blocker and stretcher system 100 comprises ball cap blocker and stretcher 1200, as shown. Preferably, ball cap blocker and stretcher 101 comprises ball cap blocker and stretcher 1200, as shown. Preferably, ball cap blocker and stretcher 1200 comprises hot air blower 1110, as shown. Preferably, crown-contourer 110 comprises crown-contourer 1210, as shown. Preferably, crown-contourer 1210 comprises steam-apertures 125 through brim-positioner 160, as shown.

Preferably, crown-contourer 110 comprises crown-contourer 1260, as shown. Preferably, crown-contourer 1260 comprises inside shell 1262 and outside shell 1264, as shown. Preferably, inside shell 1262 and outside shell 1264 fit together leaving airspace 1266 in between, as shown. Preferably, steam is directed into airspace 1266 and out through steam apertures 125 in outside shell 1264 so that the area underneath and inside crown-contourer 1260 remains dry. Preferably, air goes through air ports 1140 in inside shell 1162 and out steam-apertures 125 on outside shell 1264. Upon reading the teachings of this specification, those with ordinary skill in the art will now understand that, under appropriate circumstances, considering such issues as advances in technology, user preference, etc., other arrangements, such as other hot-air blowers, other crown-contour shapes and configurations, other air passage arrangements, other steam passage arrangements, etc., may suffice.

Preferably, ball cap blocker and stretcher 101 comprise brim region steam guide 1299 to assist in directing steam (and hot air from hot air blower) to the brim of a ball cap. Steam (and/or hot air) preferably flow through channel 1298 in inside shell 1262. Preferably, brim region steam guide 1299 comprises passages 1297 for steam and hot air, as shown. Preferably, ball cap blocker and stretcher 101 comprises a steam generator 105B (which works in a manner similar to steam generator 105 and steam generator 105B) having water tank 660B and user-controllable steam actuator 1295, as shown.

Preferably, ball cap blocker and stretcher 1200 comprises stretcher 140. Stretcher 140 is not shown in FIG. 12.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A ball cap blocking and stretching system for blocking and stretching a ball cap having a crown that includes a front, an inside surface, and a perimeter; and a brim extending from the front of the crown, comprising:

a. steamer means for blocking and steaming the ball cap including a crown-contourer having a hemispherical shape for contouring the crown of the ball cap when placed on the crown-conturer and having defined therein at least one aperture for emitting steam in use; and a steam generator for generating steam located substantially within and in communication with the crown-contourer;

b. stretcher means for stretching at least the perimeter of the crown in cooperation with the steamer means, the stretcher means including a front-contourer overlappingly provided adjacent to the crown-contourer so that the inside surface of the crown of the ball cap contacts and covers the front-contourer and the crown-contourer; mover means for cooperatively moving the front-contourer relative to the crown-contourer; and a stretcher fixator for temporarily fixing the position of the front-contourer relative to the crown-contourer when the mover means is moved; and c. a brim positioner attached to the front-contourer for positioning the brim on the ball cap blocking and stretching system.

2. The ball cap blocking and stretching system according to claim 1, wherein the steamer means is a steam generator comprising at least one water storage tank for storing water therein.

3. The ball cap blocking and stretching system according to claim 2, wherein the steam generator comprises at least one heat generator including at least one electrical heating element.

4. The ball cap blocking and stretching system according to claim 3, further comprising a steam controller for controlling steam generation by the steam generator.

5. The ball cap blocking and stretching system according to claim 4, wherein the steam controller comprises (a) a water pump that pumps water from the water storage tank to the at least one heat generator; and (b) at least one water valve that releases water from the water storage tank to the at least one heat generator.

6. The ball cap blocking and stretching system according to claim 5, wherein the at least one aperture for emitting steam to steam the crown in use comprises a plurality of steam apertures distributed about the crown-contourer.

7. The ball cap blocking and stretching system according to claim 6, wherein the front-contourer has defined therein a plurality of steam apertures that communicate with the steam generator of the steamer means and that emit steam.

8. The ball cap blocking and stretching system according to claim 1, further comprising a size indicator for indicating to a user user-selectable stretchable sizes for the ball cap when the ball cap is placed on the ball cap blocking and stretching system, wherein the user-selectable stretchable sizes are based on a position of the crown-contourer relative to the front-contourer when moved by the mover means.

9. The ball cap blocking and stretching system according to claim 8, further comprising support base means for supporting at least the steamer means, the stretcher means, and the brim positioner above a surface.

10. The ball cap blocking and stretching system according to claim 1, further comprising at least one handle to assist portable handling of the ball cap blocking and stretching system.

11. The ball cap blocking and stretching system according to claim 1, further comprising a hot air blower for blowing hot air onto the ball cap when the ball cap is placed on the crown-contourer.

12. The ball cap blocking and stretching system according to claim 11, wherein the hot air blower comprises:

a. at least one heating element for generating heat;

b. a fan to blow generated heat as hot air; and c. at least one port structured and arranged to pass the hot air from the hot air blower to the ball cap when the ball cap is placed on the crown-contourer means.

13. The ball cap blocking and stretching system according to claim 1, wherein the hot air blower is located substantially within the crown-contourer.

14. The ball cap blocking and stretching system according to claim 1, wherein the mover means comprises a screw-drive.

15. The ball cap blocking and stretching system according to claim 1, wherein the mover means comprises a ratchet-drive.

16. A ball cap blocking and stretching kit, relating to blocking and stretching a ball cap having a crown including a front, an inside surface, and a perimeter; and a brim extending from the front of the crown, the kit comprising:

a. a ball cap blocker and stretcher that comprises:

i. steamer means for blocking and steaming the ball cap that includes:

(1) a crown-contourer having a hemispherical shape for contouring the crown of the ball cap when placed on the crown-contourer and having defined therein at least one aperture for emitting steam to steam the crown in use; and (2) a steam generator for generating steam located substantially within and in communication with the crown-contourer;

ii. stretcher means for stretching at least the perimeter of the crown in cooperation with the steamer means, the stretcher means including:

(1) a front-contourer overlappingly provided adjacent to the crown-contourer so that the inside surface of the crown of the ball cap contacts and covers the front-contourer and the crown-contourer;

(2) mover means for cooperatively moving the front-contourer relative to the crown-contourer; and (3) a stretcher fixator for temporarily fixing the position of the front-contourer relative to the crown-contourer when the mover means is moved; and iii. a brim positioner attached to the front-contourer for positioning the brim on the ball cap blocker and stretcher;

b. a package for packaging the ball cap blocking and stretching kit; and c. instructions for assembly of the ball cap blocking and stretching kit.

17. The ball cap blocking and stretching kit according to claim 16, further comprising a second front-contourer interchangeable with the front-contourer and having a different profile.

18. The ball cap blocking and stretching kit according to claim 16, wherein the front-contourer has defined therein at least one front steam aperture that emits steam through the front-contourer in use.

19. The ball cap blocking and stretching kit according to claim 16, further comprising a cleaning solution for cleaning the ball cap.

20. The ball cap blocking and stretching kit according to claim 16, further comprising a stain remover solution for cleaning the ball cap.

21. The ball cap blocking and stretching kit according to claim 16, further comprising a stiffening solution for stiffening the ball cap.

22. The ball cap blocking and stretching kit according to claim 16, further comprising a washing basket for washing the ball cap prior to blocking and stretching the ball cap using the ball cap blocker and stretcher.

23. A ball cap blocking and stretching method, comprising the steps of:

a. providing a ball cap blocking and stretching system according to claim 1;

b. adding water to the steam generator of the steamer means;

c. placing a ball cap that has a crown and a brim extending from the crown on the ball cap blocking and stretching system by positioning the crown in contact with the crown-contourer of the steamer means and on the front-contourer of the stretcher means, and by positioning the brim on the brim positioner;

d. steaming at least portions of the ball cap using the steamer means;

e. adjusting the mover means for cooperatively moving the front-contourer relative to the crown-contourer so that the crown is stretched at least one of during steaming and after steaming; and f. removing the ball cap from the ball cap blocking and stretching system.

24. The ball cap blocking and stretching method according to claim 23, further comprising the step of drying the ball cap prior to the step of removing the ball cap from the ball cap blocking and stretching system.

25. The ball cap blocking and stretching method according to claim 23, further comprising the step of washing the ball cap prior to the step of placing the ball cap on the ball cap blocking and stretching system.

26. The ball cap blocking and stretching method according to claim 23, further comprising the step of applying at least one ball cap treatment solution to the ball cap.

27. The ball cap blocking and stretching method according to claim 23, wherein the step of steaming at least portions of the ball cap is restricted to steaming the crown.

28. The ball cap blocking and stretching method according to claim 23, wherein the step of steaming at least portions of the ball cap is restricted to steaming portions of the ball cap that do not comprise embroidery.

29. The ball cap blocking and stretching method according to claim 23, wherein the step of steaming at least portions of the ball cap is restricted to steaming portions of the ball cap that do not comprise decorative printing.

* * * * *